US010160922B2

(12) United States Patent
Funk

(10) Patent No.: US 10,160,922 B2
(45) Date of Patent: Dec. 25, 2018

(54) PROCESSES AND APPARATUSES FOR PRODUCTION OF OLEFINS

(71) Applicant: UOP LLC, Des Plaines, IL (US)

(72) Inventor: Gregory Funk, Carol Stream, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/331,732

(22) Filed: Oct. 21, 2016

(65) Prior Publication Data

US 2017/0233664 A1 Aug. 17, 2017

Related U.S. Application Data

(60) Provisional application No. 62/258,754, filed on Nov. 23, 2015.

(51) Int. Cl.

| | |
|---|---|
| ***C10G 63/04*** | (2006.01) |
| ***C07C 4/04*** | (2006.01) |
| ***C07C 4/06*** | (2006.01) |

(52) U.S. Cl.

CPC ..... *C10G 63/04* (2013.01); *C10G 2400/20* (2013.01); *C10G 2400/22* (2013.01); *C10G 2400/30* (2013.01)

(58) Field of Classification Search

CPC ..... C07C 4/04; C07C 4/06; C07C 5/637

USPC ... 585/319, 324, 430, 431, 648, 62, 66, 135, 585/136, 137, 138; 208/62, 66, 135, 136, 208/137, 138

See application file for complete search history.

(56) References Cited

U.S. PATENT DOCUMENTS 3,650,943 A * 3/1972 Schuller ..... C10G 59/02 208/103

* cited by examiner

*Primary Examiner* — Thuan D Dang

(57) ABSTRACT

Processes and apparatuses for the production of olefins are provided. In an embodiment, a process for production of a process is provided for increasing light olefin yield comprising passing a hydrocarbon feedstream comprising paraffins, naphthenes and aromatic hydrocarbons to a catalytic reforming unit. The hydrocarbon feedstream is contacted with a reforming catalyst under mild reforming conditions suitable for converting naphthenes into aromatics while minimizing conversion of the paraffins, to provide a reforming effluent stream. The reforming effluent stream is passed to a solvent extraction unit to provide an overhead stream comprising predominantly paraffins and a bottoms stream comprising predominantly aromatics. Finally, the overhead stream is passed to a cracking unit to provide a product stream comprising the light olefins.

20 Claims, 2 Drawing Sheets

PROCESSES AND APPARATUSES FOR PRODUCTION OF OLEFINS

CROSS-REFERENCE TO RELATED APPLICATION

This application claims priority from Provisional Application No. 62/258,754 filed Nov. 23, 2015, the contents of which are hereby incorporated by reference.

TECHNICAL FIELD

The technical field generally relates to a process for the production of olefins. More particularly, the technical field relates to processes and apparatuses for maximizing the production of olefins from a naphtha feed.

BACKGROUND

Light olefin materials, including ethylene and propylene, represent a large portion of the worldwide demand in the petrochemical industry. Light olefins are used in the production of numerous chemical products via polymerization, oligomerization, alkylation and other well-known chemical reactions. These light olefins are essential building blocks for the modern petrochemical and chemical industries. Producing large quantities of light olefin material in an economical manner, therefore, is a focus in the petrochemical industry. The main source for these materials in present day refining is the steam cracking of petroleum feeds.

Naphtha cracking is used to produce much of the world's ethylene and propylene. It is commonly known that the different types of components that make up the naphtha give very different yields to ethylene and propylene. Generally, n-paraffins give the highest yield to light olefins followed by iso-paraffins, naphthenes and finally aromatics which generally pass through the cracker with only some dealkylation. Since the cost of the naphtha feed contributes the majority of the operatings costs, it is important to maximize yields to the most valuable products which are ethylene, propylene and butadiene.

Accordingly, it is desirable to maximize the conversion of naphtha to light olefins while minimizing conversion to mixed aromatics. Further, it is desirable to simultaneously produce a paraffin rich stream that can be fed to a naphtha cracker and a high quality aromatics rich stream that can be used as feed to aromatics complexes or blended into gasoline. Furthermore, other desirable features and characteristics of the present subject matter will become apparent from the subsequent detailed description of the subject matter and the appended claims, taken in conjunction with the accompanying drawings and this background of the subject matter.

BRIEF SUMMARY

Various embodiments contemplated herein relate to processes and apparatuses for maximizing the production of olefins from a naphtha feed. The exemplary embodiments taught herein provide integration of a mild reforming unit with a naphtha cracker to maximize the production of olefins from a naphtha feed.

In accordance with an exemplary embodiment, a process is provided for increasing light olefin yield comprising passing a hydrocarbon feedstream comprising paraffins, naphthenes and aromatic hydrocarbons to a catalytic reforming unit, the hydrocarbon feedstream being contacted with a reforming catalyst under mild reforming conditions suitable for converting naphthenes into aromatics while minimizing conversion of the paraffins, to provide a reforming effluent stream. The reforming effluent stream is passed to a solvent extraction unit to provide an overhead stream comprising predominantly paraffins and a bottoms stream comprising predominantly aromatics. Finally, the overhead stream is passed to a cracking unit to provide a product stream comprising the light olefins.

In accordance with another exemplary embodiment, a process is provided for increasing light olefin yield comprising passing a naphtha feedstream comprising paraffins, naphthenes and aromatic hydrocarbons to a catalytic reforming unit, the naphtha feedstream being contacted with a reforming catalyst comprising at least one platinum-group metal component under mild reforming conditions comprising a pressure ranging from 0 to 3500 kPa(g), a temperature ranging from 300 to 500° C. to carry out mild catalytic reforming reaction so as to achieve a naphthene conversion of greater than 80 mass %, and a paraffin conversion of less than about 20 mass %, to provide a reforming effluent stream. The reforming effluent stream is passed to a solvent extraction unit to provide an overhead stream comprising predominantly paraffins and a bottoms stream comprising predominantly aromatics. Finally, the overhead stream is passed to a naphtha cracker to provide a product stream comprising the light olefins.

BRIEF DESCRIPTION OF THE DRAWINGS

The various embodiments will hereinafter be described in conjunction with the following FIGURES, wherein like numerals denote like elements.

DEFINITIONS

Figure 1:
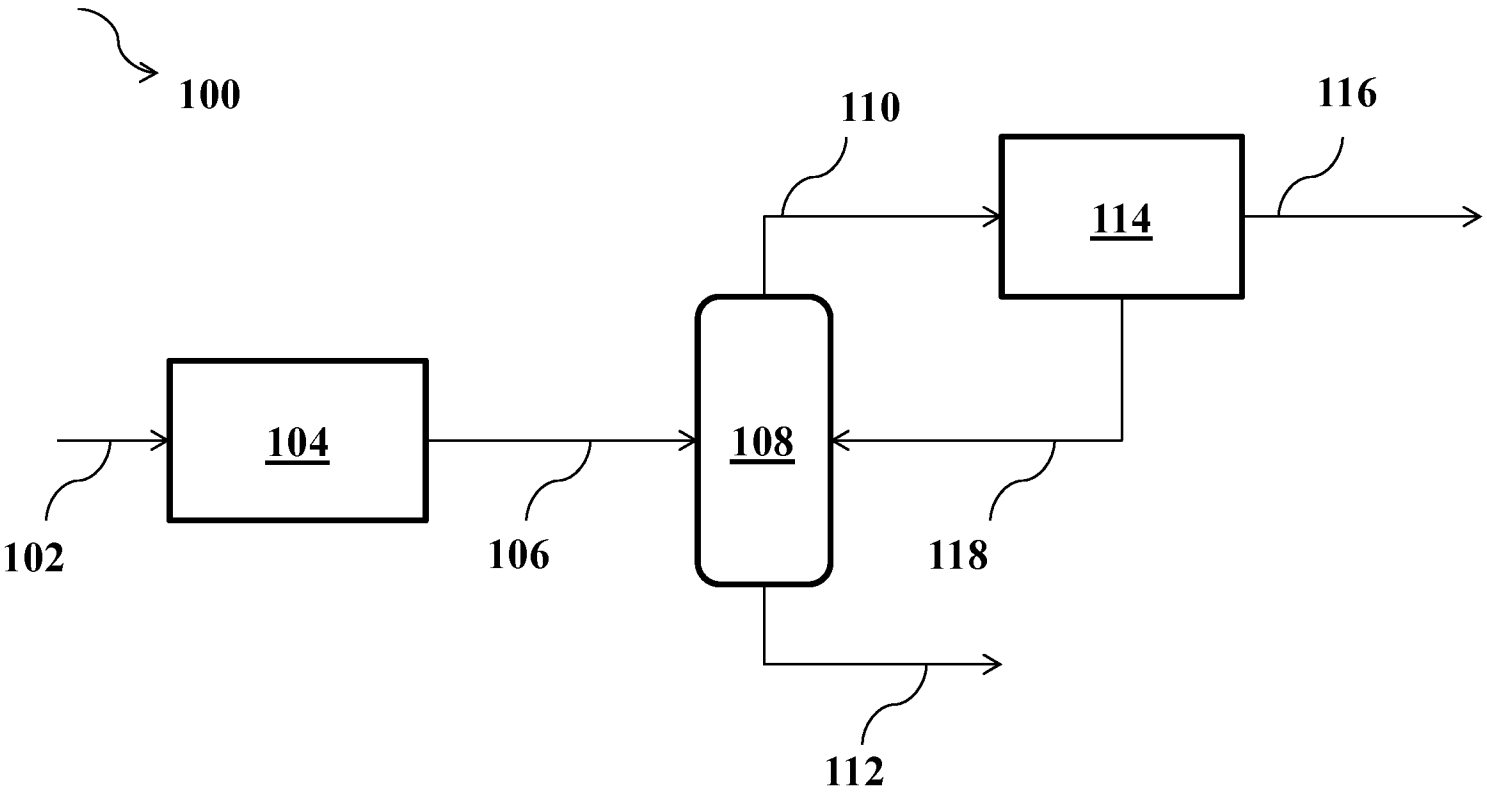
FIG. 1 is a schematic diagram of a process and an apparatus for the production of olefins in accordance with an exemplary embodiment.

As used herein, the term "stream" can include various hydrocarbon molecules and other substances.

The notation "Cx" means hydrocarbon molecules that have "x" number of carbon atoms, Cx+ means hydrocarbon molecules that have "x" and/or more than "x" number of carbon atoms, and Cx− means hydrocarbon molecules that have "x" and/or less than "x" number of carbon atoms.

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and nonaromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three or more carbon atoms. Also, the term "stream" can include or consist of other fluids, such as a hydrogen. Also, the symbol "A" in conjunction with a numeral and/or a superscript plus or minus may be used below to represent one or more aromatic compounds. As an example, the abbreviation "A9" may represent one or more aromatic C9 hydrocarbons.

The term "light olefins" means the hydrocarbon material boiling in the range less than 38° C. atmospheric equivalent boiling point (AEBP) as determined by any standard gas chromatographic simulated distillation method such as ASTM D2887, all of which are used by the petroleum industry. The term "light olefins" includes $C_2$, $C_3$, and $C_4$ olefins.

As used herein, the term "overhead stream" can mean a stream withdrawn at or near a top of a vessel, such as a column.

As used herein, the term "bottom stream" can mean a stream withdrawn at or near a bottom of a vessel, such as a column.

As depicted, process flow lines in the FIGURES can be referred to interchangeably as, e.g., lines, pipes, feeds, gases, products, discharges, parts, portions, or streams.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column.

As used herein, the term "naphtha" means the hydrocarbon material boiling in the range between about 10° C. and about 200° C. atmospheric equivalent boiling point (AEBP) as determined by any standard gas chromatographic simulated distillation method such as ASTM D2887, all of which are used by the petroleum industry. The hydrocarbon material may be more contaminated and contain a greater amount of aromatic compounds than is typically found in refinery products.

As used herein, the term "predominantly" means a majority, suitably at least 80 wt % and preferably at least 90 wt %.

As used herein, the term "rich" or "enriched" can mean an amount of generally at least about 50%, and preferably about 70%, by mole, of a compound or class of compounds in a stream.

As used herein, the term "substantially" can mean an amount of at least generally about 80%, preferably about 90%, and optimally about 99%, by weight, of a compound or class of compounds in a stream.

As used herein, the term "passing" includes "feeding" and means that the material passes from a conduit or vessel to an object.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

An embodiment of a process for the production of olefins is addressed with reference to a process and apparatus 100 providing integration of a mild reforming unit with a cracking unit for maximizing the production of olefins as shown in FIG. 1. The apparatus and method 100 includes a catalytic reforming unit 104, a solvent extraction unit 108 and a cracking unit 114. In accordance with the process as shown in FIG. 1, a hydrocarbon feedstream 102 is passed to the catalytic reforming unit 104. The hydrocarbon feedstream 102 may include paraffins, naphthenes and aromatic hydrocarbons. In accordance with the instant embodiment as discussed here, the hydrocarbon feedstream 102 is a naphtha feedstream 102. The typical petroleum derived naphtha contains a wide variety of different hydrocarbon types including normal paraffins, branched paraffins, olefins, naphthenes, benzene, and alkyl aromatics. Although the present embodiment is exemplified by a naphtha feedstream, the process is not limited to a naphtha feedstream, and can include any feedstream with a composition that overlaps with a naphtha feedstream. For a naphtha feedstream, the cracking unit 114 can be a naphtha cracking unit. The catalytic reforming unit 104 may be a continuous catalytic reforming unit wherein the catalyst is in a moving bed, and the catalyst is cycled through the reactor to a regenerator for regenerating the catalyst. This provides for a continuous process.

In the catalytic reforming unit 104, the naphtha feedstream 102 is contacted with a reforming catalyst under mild reforming conditions suitable for converting naphthenes into aromatics while minimizing conversion of the paraffins. The mild reforming conditions includes a temperature of from about 300° C. to about 500° C., preferably from about 400° C. to about 475° C. and a pressure from about 0 kPa(g) to about 3500 kPa(g), preferably from about 275 kPa(g) to about 700 kPa(g). The hydrogen to hydrocarbon molar ratio is typically about 1:1 to about 10:1, preferably from about 2:1 to about 6:1. In accordance with various embodiments, the naphthene conversion is greater than about 80 mass % and the paraffin conversion is less than about 20 mass %. In one example, the naphthene conversion is greater than about 90 mass % and the paraffin conversion is less than about 10 mass %.

Reforming catalysts generally comprise a metal on a support. This catalyst is conventionally a dual-function catalyst that includes a metal hydrogenation-dehydrogenation catalyst on a refractory support. The support can include a porous material, such as an inorganic oxide or a molecular sieve, and a binder with a weight ratio from 1:99 to 99:1. In accordance with various embodiments, the reforming catalyst comprises a noble metal comprising one or more of platinum, palladium, rhodium, ruthenium, osmium, and iridium. The reforming catalyst is supported on refractory inorganic oxide support comprising one or more of alumina, a chlorided alumina a magnesia, a titania, a zirconia, a chromia, a zinc oxide, a thoria, a boria, a silica-alumina, a silica-magnesia, a chromia-alumina, an alumina-boria, a silica-zirconia and a zeolite. Porous materials and binders are known in the art and are not discussed in detail here.

A reforming effluent stream 106 is withdrawn from the catalytic reforming unit 104. The reforming effluent stream 106 is passed to the solvent extraction unit 108. In the solvent extraction unit 108, the aromatics present in the reforming effluent stream 106 can be separated from the paraffins by solvent extraction or adsorption. Solvent compositions are selected from the classes which have high selectivity for aromatic hydrocarbons and are known to those of ordinary skill in the hydrocarbon-processing art. Solvent-extraction conditions are generally well known to those trained in the art and vary depending on the particular aromatic-selective solvent utilized. The solvent extraction process separates the reforming effluent stream 106 into an overhead stream 110 comprising predominantly paraffins, and a bottoms stream 112 comprising predominantly aromatics. Subsequently, the overhead stream 110 is passed to the cracking unit 114 to provide a product stream 116 comprising the light olefins. In accordance with the instant flow scheme as discussed, the cracking unit 114 is a naphtha cracking unit 114. The naphtha cracking unit 114 can be a catalytic naphtha cracker, or a naphtha steam cracker.

The product stream 116 is a light olefin stream rich in ethylene and propylene which may be subsequently passed to the light olefin separation unit (not shown). In addition, the naphtha cracking unit 114 generates a byproduct known as pyrolysis gasoline (pygas) withdrawn as a pygas stream 118. The pygas is a mixture of light hydrocarbons which is highly olefinic and includes butanes, butenes, other alkanes, olefins, diolefins, aromatics, such as benzene and toluene, and naphthenes. The pygas stream 118 is recycled to the solvent extraction unit 108.

It is an advantage over conventional processes that due to the mild reforming conditions employed in the catalytic reforming unit 104, majority of paraffins will not undergo conversion and the subsequent solvent extraction unit 108 further separates the aromatics present in the reforming effluent stream 106 from the paraffins to provide a paraffin enriched stream i.e. the overhead stream 110. Accordingly, production of olefins in the product stream 116 from the naphtha stream 102 is maximized.

Figure 2:
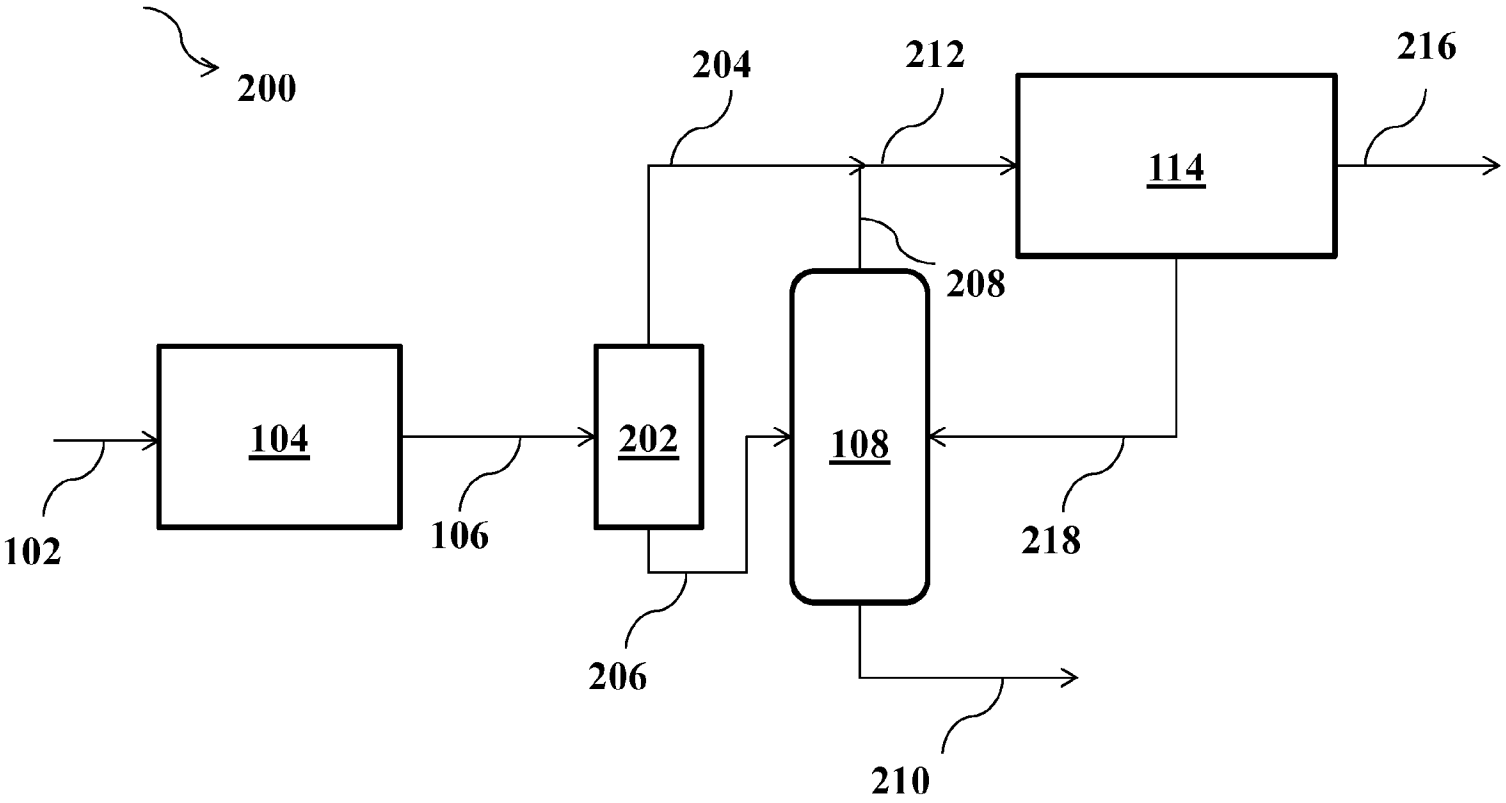
FIG. 2 is a schematic diagram of a process and an apparatus for the production of olefins in accordance with another exemplary embodiment.

Turning now to FIG. 2, another embodiment for the production of olefins is addressed with reference to a process and apparatus 200 providing integration of a mild reforming unit with a cracking unit for maximizing the production of olefins wherein the process and apparatus 200 includes a fractionation column 202. Many of the elements in FIG. 2 have the same configuration as in FIG. 1 and bear the same respective reference number and have similar operating conditions. Further, the temperature, pressure and composition of various streams are similar to the corresponding streams in FIG. 1, unless specified otherwise. As illustrated in the instant Figure, the reforming effluent stream 106 is passed to the fractionation column 202 to provide a fractionator overhead stream 204 comprising $C_{6-}$ hydrocarbons and a fractionator bottoms stream 206 comprising $C_{6+}$ hydrocarbons. The fractionator overhead stream 204 is sent to the naphtha cracking unit 114. The fractionator bottoms stream 206 is passed to the solvent extraction unit 108. An overhead stream 208 comprising predominantly paraffins and a bottoms stream 210 comprising predominantly aromatics is withdrawn from the solvent extraction unit 208. The overhead stream 208 combines with the fractionator overhead stream 204 to provide a combined stream 212 which is subsequently passed to the naphtha cracking unit 114 to provide a product stream 216 comprising the light olefins. A pygas stream 218 is withdrawn from the naphtha cracking unit 114 and is recycled to the solvent extraction unit 108.

It is an advantage of the instant flow scheme, that due to the presence of fractionation column 202 upstream of the solvent extraction unit 108, majority of light hydrocarbons will removed in the fractionation column 202, thus help to reduce size and utilities of the solvent extraction unit 108 resulting is cost savings.

EXAMPLE

The following is an example of the olefin production process, in accordance with an exemplary embodiment, that is similarly configured to the process and apparatus 100 illustrated in the FIG. 1. The example is provided for illustration purposes only and is not meant to limit the various embodiments of apparatuses and methods for olefin production in any way.

In an exemplary case study, a comparison was made between olefin production prepared according to the process flow scheme as disclosed in the instant invention using a mild reforming unit integrated with an aromatics extraction unit and a naphtha cracking unit, with a conventional flow scheme. In the conventional flow scheme, the naphtha feedstream in sent to a conventional catalytic reforming unit operating under conventional temperature and pressure. Further, a portion of the naphtha stream is sent directly to the naphtha cracking unit. An increase in A9, A10 and A11 yield is noted in the instant process as illustrated in Table 1 showing the cracker product comparison of the instant flow scheme with the conventional process.

TABLE 1

Aromatics Product Comparison

| Key Product | Conventional Flow Scheme MTH | Mild Reforming MTH | Delta MTH | % Increase |
|---|---|---|---|---|
| A6 | 24.0 | 16.8 | −7.2 | −29.9 |
| A7 | 84.6 | 79.6 | −5.0 | −5.9 |
| A8 | 102.6 | 99.1 | −3.5 | −3.4 |
| A9 | 58.4 | 71.4 | 13.0 | 22.3 |
| A10 | 14.9 | 17.3 | 2.4 | 16.1 |
| A11+ | 1.1 | 1.3 | 0.2 | 18.2 |
| Total | 285.6 | 285.6 | — | — |

Further, a substantial increase in propylene yield and unconverted paraffins occurs as illustrated in Table 2 showing the cracker product comparison.

TABLE 2

Cracker Product Comparison

| Key Product | Conventional Flow Scheme MTH | Mild Reforming MTH | Delta MTH | % Increase |
|---|---|---|---|---|
| Ethylene | 131.1 | 126.4 | −4.7 | −3.6 |
| Propylene | 62.0 | 83.9 | 21.9 | 35.3 |
| Butadiene | 24.3 | 25.8 | 1.5 | 6.2 |
| Hydrogen | 6.7 | 5.6 | −1.1 | −16.4 |
| Raffinate-1 | 11.9 | 20.4 | 8.5 | 71.4 |

TABLE 2-continued

| Cracker Product Comparison | | | | |
|---|---|---|---|---|
| Key Product | Conventional Flow Scheme MTH | Mild Reforming MTH | Delta MTH | % Increase |
| C5's | 14.2 | 20.4 | 6.2 | 43.7 |
| Pygas | 66.3 | 49.3 | −17.0 | −25.6 |
| Methane | 67.3 | 60.3 | −7.0 | −10.4 |
| Other | 12.8 | 7.9 | −4.9 | −38.3 |
| Total | 396.6 | 400.0 | — | — |

As shown in the Table 2 above, the propylene yield increases by 35.3%. Further, an increase in yield of unconverted paraffins in the raffinate is noted. The paraffins may be recycled to increase the olefins yield further. Further, the delta obtained in the total product is due to higher production of hydrogen from the conventional reforming unit.

Specific Embodiments

While the following is described in conjunction with specific embodiments, it will be understood that this description is intended to illustrate and not limit the scope of the preceding description and the appended claims.

A first embodiment of the invention is a process for increasing light olefin yield comprising a) passing a hydrocarbon feedstream comprising paraffins, naphthenes and aromatic hydrocarbons to a catalytic reforming unit, the hydrocarbon feedstream being contacted with a reforming catalyst under mild reforming conditions suitable for converting naphthenes into aromatics while minimizing conversion of the paraffins, to provide a reforming effluent stream; b) passing the reforming effluent stream to a solvent extraction unit to provide an overhead stream comprising predominantly paraffins and a bottoms stream comprising predominantly aromatics; and c) passing the overhead stream to a cracking unit to provide a product stream comprising the light olefins. An embodiment of the invention is one, any or all of prior embodiments in this paragraph up through the first embodiment in this paragraph, wherein the hydrocarbon feedstream is a naphtha feedstream and the cracking unit is a catalytic naphtha cracker, or a naphtha steam cracker. An embodiment of the invention is one, any or all of prior embodiments in this paragraph up through the first embodiment in this paragraph, wherein the mild reforming conditions comprise a temperature of about 300° C. to about 500° C. An embodiment of the invention is one, any or all of prior embodiments in this paragraph up through the first embodiment in this paragraph, wherein the mild reforming conditions comprise a temperature of about 400° C. to about 475° C. An embodiment of the invention is one, any or all of prior embodiments in this paragraph up through the first embodiment in this paragraph, wherein the mild reforming conditions comprise a pressure of about 0 kPa(g) to about 3500 kPa(g). An embodiment of the invention is one, any or all of prior embodiments in this paragraph up through the first embodiment in this paragraph, wherein the mild reforming conditions comprise a pressure of about 275 kPa(g) to about 700 kPa(g). An embodiment of the invention is one, any or all of prior embodiments in this paragraph up through the first embodiment in this paragraph, wherein the mild reforming conditions comprise a hydrogen to hydrocarbon molar ratio of about 11 to about 101. An embodiment of the invention is one, any or all of prior embodiments in this paragraph up through the first embodiment in this paragraph, wherein the mild reforming conditions comprise a hydrogen to hydrocarbon molar ratio of about 21 to about 61. An embodiment of the invention is one, any or all of prior embodiments in this paragraph up through the first embodiment in this paragraph, wherein the naphthene conversion is greater than about 80 mass % and the paraffin conversion is less than about 20 mass %. An embodiment of the invention is one, any or all of prior embodiments in this paragraph up through the first embodiment in this paragraph, wherein the naphthene conversion is greater than about 90 mass % and the paraffin conversion is less than about 10 mass %. An embodiment of the invention is one, any or all of prior embodiments in this paragraph up through the first embodiment in this paragraph, wherein the reforming catalyst comprises a noble metal comprising one or more of platinum, palladium, rhodium, ruthenium, osmium, and iridium. An embodiment of the invention is one, any or all of prior embodiments in this paragraph up through the first embodiment in this paragraph wherein the reforming catalyst is supported on refractory inorganic oxide support comprising one or more of alumina, a chlorided alumina a magnesia, a titania, a zirconia, a chromia, a zinc oxide, a thoria, a boria, a silica-alumina, a silica-magnesia, a chromia-alumina, an alumina-boria, a silica-zirconia and a zeolite. An embodiment of the invention is one, any or all of prior embodiments in this paragraph up through the first embodiment in this paragraph further comprising a modifier component selected from the group consisting of titanium, niobium, rare earth elements, tin, rhenium, zinc, germanium and mixtures thereof. An embodiment of the invention is one, any or all of prior embodiments in this paragraph up through the first embodiment in this paragraph further comprising passing the reforming effluent stream to a fractionation column to provide a fractionator overhead stream comprising C6− hydrocarbons and a fractionator bottoms stream comprising C6+ hydrocarbons and sending the fractionator bottoms stream to the solvent extraction unit. An embodiment of the invention is one, any or all of prior embodiments in this paragraph up through the first embodiment in this paragraph further comprising sending the fractionator overhead stream to the cracking unit. An embodiment of the invention is one, any or all of prior embodiments in this paragraph up through the first embodiment in this paragraph further comprising recycling a pygas stream from the cracking unit to the solvent extraction unit.

A second embodiment of the invention is a process for increasing light olefin yield comprising a) passing a naphtha feedstream comprising paraffins, naphthenes and aromatic hydrocarbons to a catalytic reforming unit, the naphtha feedstream being contacted with a reforming catalyst comprising at least one platinum-group metal component under mild reforming conditions comprising a pressure ranging from 0 to 3500 kPa(g), a temperature ranging from 300 to 500° C. to carry out mild catalytic reforming reaction so as to achieve a naphthene conversion of greater than 80 mass %, and a paraffin conversion of less than about 20 mass %, to provide a reforming effluent stream; b) passing the reforming effluent stream to a solvent extraction unit to provide an overhead stream comprising predominantly paraffins and a bottoms stream comprising predominantly aromatics; and c) passing the overhead stream to a naphtha cracker to provide a product stream comprising the light olefins. An embodiment of the invention is one, any or all of prior embodiments in this paragraph up through the second embodiment in this paragraph, wherein the mild reforming conditions comprise a temperature of about 400° C. to about 475° C. An embodiment of the invention is one, any or all of prior embodiments in this paragraph up through the second embodiment in this paragraph, wherein the mild reforming conditions comprise a pressure of about 275 kPa(g) to about 700 kPa(g). An embodiment of the invention is one, any or all of prior embodiments in this paragraph up through the second embodiment in this paragraph, wherein the naphthene conversion is greater than 90 mass %, and the paraffin conversion is less than about 10 mass %.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for increasing light olefin yield comprising:

passing a hydrocarbon feedstream comprising paraffins, naphthenes and aromatic hydrocarbons to a catalytic reforming unit, the hydrocarbon feedstream being contacted with a reforming catalyst under mild reforming conditions suitable for converting naphthenes into aromatics while minimizing conversion of the paraffins, to provide a reforming effluent stream;

passing the reforming effluent stream to a solvent extraction unit to provide an overhead stream comprising predominantly paraffins and a bottoms stream comprising predominantly aromatics, wherein the overhead stream comprises $C_6$– hydrocarbons;

passing the overhead stream to a naphtha cracker to provide a product stream comprising the light olefins; and, recycling a recycle stream from the naphtha cracker to the solvent extraction unit, wherein the recycle stream comprises butanes, butenes, and aromatics.

2. The process of claim 1, wherein the hydrocarbon feedstream is a naphtha feedstream and the naphtha cracker is a catalytic naphtha cracker, or a naphtha steam cracker.

3. The process of claim 1, wherein the mild reforming conditions comprise a temperature of about 300° C. to about 500° C.

4. The process of claim 3, wherein the mild reforming conditions comprise a temperature of about 400° C. to about 475° C.

5. The process of claim 1, wherein the mild reforming conditions comprise a pressure of about 0 kPa(g) to about 3500 kPa(g).

6. The process of claim 5, wherein the mild reforming conditions comprise a pressure of about 275 kPa(g) to about 700 kPa(g).

7. The process of claim 1, wherein the mild reforming conditions comprise a hydrogen to hydrocarbon molar ratio of about 1:1 to about 10:1.

8. The process of claim 7, wherein the mild reforming conditions comprise a hydrogen to hydrocarbon molar ratio of about 2:1 to about 6:1.

9. The process of claim 1, wherein the naphthene conversion is greater than about 80 mass % and the paraffin conversion is less than about 20 mass %.

10. The process of claim 9, wherein the naphthene conversion is greater than about 90 mass % and the paraffin conversion is less than about 10 mass %.

11. The process of claim 1, wherein the reforming catalyst comprises a noble metal comprising one or more of platinum, palladium, rhodium, ruthenium, osmium, and iridium.

12. The process of claim 11 wherein the reforming catalyst is supported on refractory inorganic oxide support comprising one or more of alumina, a chlorided alumina a magnesia, a titania, a zirconia, a chromia, a zinc oxide, a thoria, a boria, a silica-alumina, a silica-magnesia, a chromia-alumina, an alumina-boria, a silica-zirconia and a zeolite.

13. The process of claim 11 further comprising a modifier component selected from the group consisting of titanium, niobium, rare earth elements, tin, rhenium, zinc, germanium and mixtures thereof.

14. The process of claim 1 further comprising passing the reforming effluent stream to a fractionation column to provide a fractionator overhead stream comprising C6– hydrocarbons and a fractionator bottoms stream comprising C6+ hydrocarbons and sending the fractionator bottoms stream to the solvent extraction unit.

15. The process of claim 14 further comprising sending the fractionator overhead stream to the cracking unit.

16. The process of claim 1 wherein the recycle stream comprises a pygas stream from the naphtha cracker.

17. A process for increasing light olefin yield comprising:

passing a naphtha feedstream comprising paraffins, naphthenes and aromatic hydrocarbons to a catalytic reforming unit, the naphtha feedstream being contacted with a reforming catalyst comprising at least one platinum-group metal component under mild reforming conditions comprising a pressure ranging from 0 to 3500 kPa(g), a temperature ranging from 300 to 500° C. to carry out mild catalytic reforming reaction so as to achieve a naphthene conversion of greater than 80 mass %, and a paraffin conversion of less than about 20 mass %, to provide a reforming effluent stream;

passing the reforming effluent stream to a solvent extraction unit to provide an overhead stream comprising predominantly paraffins and a bottoms stream comprising predominantly aromatics, wherein the overhead stream comprises $C_{6-\ hydrocarbons}$;

passing the overhead stream to a naphtha cracker to provide a product stream comprising the light olefins; and, recycling a recycle stream from the naphtha cracker to the solvent extraction unit, wherein the recycle stream comprises butanes, butenes, and aromatics.

18. The process of claim 17, wherein the mild reforming conditions comprise a temperature of about 400° C. to about 475° C.

19. The process of claim 17, wherein the mild reforming conditions comprise a pressure of about 275 kPa(g) to about 700 kPa(g).

20. The process of claims 17, wherein the naphthene conversion is greater than 90 mass %, and the paraffin conversion is less than about 10 mass %.

* * * * *